US010040285B2

(12) United States Patent
Oikawa et al.

(10) Patent No.: US 10,040,285 B2
(45) Date of Patent: Aug. 7, 2018

(54) LIQUID EJECTION HEAD AND LIQUID EJECTION DEVICE, AND AGING TREATMENT METHOD AND INITIAL SETUP METHOD FOR A LIQUID EJECTION DEVICE

(71) Applicant: CANON KABUSHIKI KAISHA, Tokyo (JP)

(72) Inventors: Masaki Oikawa, Inagi (JP); Yoshihiro Hamada, Yokohama (JP); Takuya Hatsui, Tokyo (JP); Makoto Sakurai, Kawasaki (JP); Takeru Yasuda, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/229,486

(22) Filed: Aug. 5, 2016

(65) Prior Publication Data

US 2017/0057228 A1 Mar. 2, 2017

(30) Foreign Application Priority Data

Aug. 27, 2015 (JP) ..... 2015-168053

(51) Int. Cl.
*B41J 2/14* (2006.01)

(52) U.S. Cl.
CPC ..... *B41J 2/14129* (2013.01)

(58) Field of Classification Search
CPC ..... B41J 2/14129
See application file for complete search history.

(56) References Cited

U.S. PATENT DOCUMENTS

| | | | | |
|---|---|---|---|---|
| 8,833,901 | B2 | 9/2014 | Hamada et al. | |
| 9,044,948 | B2 * | 6/2015 | Kato | B41J 2/1648 |
| 2015/0097892 | A1 * | 4/2015 | Nagaoka | B41J 2/1404 347/20 |

FOREIGN PATENT DOCUMENTS

| | | | |
|---|---|---|---|
| JP | H0410940 | A | 1/1992 |
| JP | H410941 | A | 1/1992 |
| JP | 2007-261170 | A | 10/2007 |

* cited by examiner

*Primary Examiner* — Jason Uhlenhake
(74) *Attorney, Agent, or Firm* — Fitzpatrick Cella Harper and Scinto

(57) ABSTRACT

A liquid ejection head, including: a flow path forming member including a resin layer having an ejection orifice and a flow path formed therein; a substrate including a heat-generating resistance element for ejecting liquid and a protective layer having a portion for covering the heat-generating resistance element, a surface of the portion being exposed to the flow path; and an intermediate layer formed between the resin layer and the protective layer, the intermediate layer including a silicon carbonitride material.

24 Claims, 6 Drawing Sheets

LIQUID EJECTION HEAD AND LIQUID EJECTION DEVICE, AND AGING TREATMENT METHOD AND INITIAL SETUP METHOD FOR A LIQUID EJECTION DEVICE

BACKGROUND OF THE INVENTION

Field of the Invention

The present invention relates to a liquid ejection head and a liquid ejection device, and an aging treatment method and an initial setup method for a liquid ejection device.

Description of the Related Art

Recording methods using an ink jet recording head, which is typical as a liquid ejection head, include a method of recording an image, a character, or the like through heating and bubbling ink by a heat-generating resistance element and ejecting, using the bubbling, the ink onto a recording medium.

In recent years, as a method of attaining faster print processing, a recording element substrate of a liquid ejection head is increased in length.

Further, it is also demanded to improve light resistance and gas resistance of a printed matter through drastic change in ink composition. In order to eject ink used for such a purpose, a material of the recording element substrate is required to be resistant to such ink.

When the recording element is increased in length, the recording element substrate is more liable to be affected by distortion due to stress caused based on difference in linear expansion coefficient between structural members of the recording element substrate in accordance with the frequency of use of the liquid ejection head. For example, in a structure in which a substrate and a resin layer serving as a flow path forming member are joined together, distortion sometimes occurs due to stress caused by difference in linear expansion coefficient between the substrate and the resin layer serving as the flow path forming member, and a defect such as separation is more liable to occur between the substrate and the resin layer.

In Japanese Patent Application Laid-Open No. 2007-261170, there is described an ink jet recording head in which, through forming a film formed of SiO or SiN as an adhesion improvement layer on an upper protective film (of Ta, Ir, or the like) formed on a substrate, adhesion between the substrate and a flow path forming member is improved. In Japanese Patent Application Laid-Open No. 2007-261170, there is described that, through using such an adhesion improvement layer, even when the ink jet recording head is increased in length, satisfactory adhesion between the substrate and the flow path forming member can be secured for a long time.

When ink composition is drastically changed, depending on an ingredient of the ink, the ink may act on an interface between the substrate and the flow path forming member to cause a defect such as separation at the interface depending on the frequency of use. Exemplary changes in ink composition include use of a self-dispersed pigment containing an acrylic polymer as a water-soluble resin for improving a fixing property of an image and bisphosphonic acid.

When such a defect is caused, the ink sometimes penetrates into the substrate to cause corrosion of wiring. As a result, satisfactory printing cannot be obtained, or it is difficult to secure quality and reliability over a long time.

Even when the flow path forming member and the upper protective film on the substrate side are joined together via the adhesion improvement layer that is formed of SiO or SiN as described in Japanese Patent Application Laid-Open No. 2007-261170, if the ink contains an ingredient that dissolves SiO or SiN, it is highly likely that a defect such as separation is caused by dissolution of the adhesion improvement layer.

SUMMARY OF THE INVENTION

It is an object of the present invention to provide a liquid ejection head and a liquid ejection device that are satisfactorily resistant to liquid, that include a joined portion having a high strength between a substrate and a flow path forming member, and that can secure a satisfactory printing state and reliability over a long time.

According to one embodiment of the present invention, there is provided a liquid ejection head, including:

a flow path forming member including a resin layer having an ejection orifice and a flow path formed therein;

a substrate including a heat-generating resistance element for ejecting liquid and a protective layer having a portion for covering the heat-generating resistance element, a surface of the portion being exposed to the flow path; and an intermediate layer formed between the resin layer and the protective layer, the intermediate layer including a silicon carbonitride material.

Further features of the present invention will become apparent from the following description of exemplary embodiments with reference to the attached drawings.

DESCRIPTION OF THE EMBODIMENTS

Figure 1A:
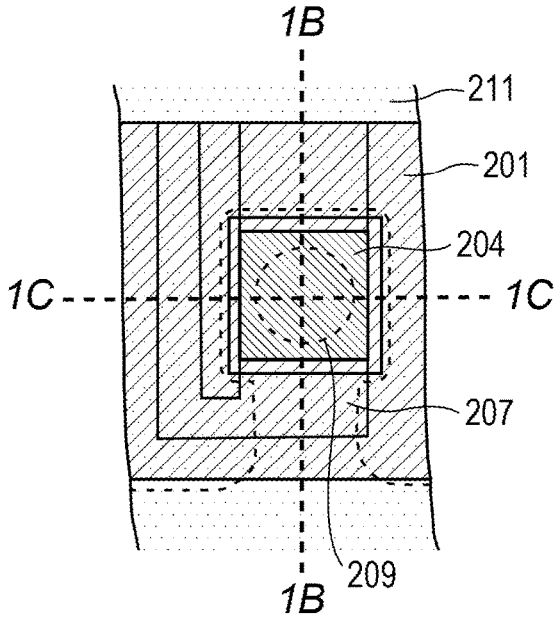
FIG. 1A, FIG. 1B, and FIG. 1C are a schematic plan view and schematic sectional views for illustrating a structure of a portion of a liquid ejection head having an ejection orifice arranged therein before aging treatment according to a first example of the present invention.

Through joining together a protective layer on a substrate side and a resin layer on a flow path forming member side via an intermediate layer that contains a silicon carbonitride material, even when liquid such as ink dissolving a SiO film or a SiN film is used, satisfactory adhesion between the flow path forming member and the substrate can be maintained, which enables provision of a liquid ejection head and a liquid ejection device having a satisfactory printing state and reliability over a long time.

A liquid ejection head according to the present invention includes a recording element substrate having a structure in which a substrate having a heat-generating resistance element formed thereon and a flow path forming member for forming an ejection orifice and a flow path above the substrate are joined together.

The heat-generating resistance element generates thermal energy for ejecting liquid through the ejection orifice. The substrate has wiring arranged thereon for driving the heat-generating resistance element. The heat-generating resistance element and the wiring are electrically isolated from each other by an insulating layer covering those components so that the heat-generating resistance element can be driven. The flow path forming member has a resin layer formed of a resin material that can be patterned such as a photo-curable resin, and the ejection orifice and the flow path communicating with the ejection orifice are formed in the resin layer.

An inner wall portion forming the flow path is a liquid contact portion as a portion to be in contact with liquid in the flow path, and includes a portion on the flow path forming member side (for example, a side wall portion and a ceiling portion) and a portion on the substrate side (for example, a bottom portion). The substrate-side portion of the inner wall portion of the flow path is formed of at least part of the protective layer. Through joining together the substrate and the flow path forming member at a joined portion located at a portion other than the flow path, the flow path is formed.

A portion of the protective layer in the flow path that is opposed to the heat-generating resistance element forms a liquid contact portion on the substrate side. Thermal energy from the heat-generating resistance element acts on the liquid in the flow path via the liquid contact portion on the substrate side. In other words, a surface to be in contact with the liquid in the flow path is formed on the protective layer. A portion in the flow path on which the thermal energy from the heat-generating resistance element acts functions as a bubbling chamber. The thermal energy imparted from the heat-generating resistance element acts on the liquid supplied to the bubbling chamber to cause bubbling in the liquid, thereby ejecting a liquid droplet through the ejection orifice.

The protective layer on the substrate side is formed on the insulating layer covering the heat-generating resistance element for an anti-cavitation function and in order to protect the insulating layer, a heat-generating resistance layer, the wiring, and the like from the liquid in the flow path.

According to the present invention, an intermediate layer containing a silicon carbonitride material is formed between the resin layer on the flow path forming member side and the protective layer on the substrate.

Through forming the joined portion of the resin layer on the flow path forming member side and the protective layer on the substrate side via the intermediate layer that contains the silicon carbonitride material, adhesion and an anti-liquid property of the joined portion can be improved.

Further, the intermediate layer may include a silicon carbonitride material expressed by the following composition formula (I):

$$Si_xC_yN_z, \quad (I)$$

where $x+y+z=100$ (at. %), $30 \leq x \leq 59$ (at. %), $y \geq 5$ (at. %), and $z \geq 15$ (at. %).

Through forming the joined portion via the intermediate layer that contains the silicon carbonitride material having the composition specified above, the adhesion and the anti-liquid property of the joined portion can be further improved.

Further, the intermediate layer can contain a material expressed by the formula (I) above in which $y \geq 16$ at. %. This can further improve the anti-liquid property. In the joined portion of the resin layer on the flow path forming member side and the protective layer on the substrate side, an organic intermediate layer can be additionally used along with the intermediate layer. In this case, the joined portion of the resin layer on the flow path forming member side and the protective layer on the substrate side is formed via a laminated structure including the intermediate layer and the organic intermediate layer laminated in this order on the protective layer. The organic intermediate layer can be used using a polyetheramide resin or the like. It is preferred that a portion of the liquid contact portion on the substrate side in the bubbling chamber that is opposed to the heat-generating resistance element be formed as a surface on which a surface of the protective layer on the substrate side is exposed. Such a structure of the bubbling chamber enables imparting of thermal energy from the heat-generating resistance element to the liquid in the bubbling chamber with thermal efficiency.

A structure relating to the relationship between the arrangement of the heat-generating resistance element and the direction of ejection of a liquid droplet through the ejection orifice is not specifically limited, but from the viewpoint of easy arrangement of a large number of ejection orifices with a high density above the recording element substrate, it is preferred that the structure enable ejection of a liquid droplet in a direction intersecting, in particular, perpendicular to, a surface of the substrate having the heat-generating resistance element formed thereon.

Through mounting the liquid ejection head according to the present invention on a liquid ejection device including a control unit configured to control operation of the liquid ejection head, a recording medium supply unit configured to supply a recording medium to an operating position of the liquid ejection head, and the like, a liquid ejection device in which the liquid ejection head has satisfactory durability and the reliability can be maintained during use for a long time can be provided. The liquid ejection device can be used in recording a character, an image, or the like on a recording medium using ink, surface treatment of a recording medium using surface treatment liquid, or the like.

The liquid ejection head according to the present invention can be manufactured in the following steps.

(A) A step of preparing a substrate having a heat-generating resistance element and a protective layer formed on the heat-generating resistance element.

(B) A step of forming an intermediate layer containing a silicon carbonitride material on the protective layer for protecting the heat-generating resistance element arranged on the substrate.

(C) A step of forming, on the substrate, a flow path forming member including a resin layer having an ejection orifice and a flow path that communicates with the ejection orifice formed therein, and, forming a joined portion of the protective layer and the resin layer via an intermediate layer and a liquid contact portion on the substrate side as a portion of the protective layer covered with the intermediate layer.

(D) A step of removing a portion of the intermediate layer opposed to the heat-generating resistance element from the liquid contact portion on the substrate side, which is the portion of the protective layer covered with the intermediate layer.

The substrate prepared in Step (A) has, on a base formed of a material such as silicon, a structure necessary for generating energy required for ejecting liquid including the heat-generating resistance element such as a heat generating resistor and wiring for driving the heat-generating resistance element. A thermal storage and electrically insulating layer is formed as necessary in a region under the heat-generating resistance element, and an electrically insulating layer or the like is formed as necessary in a region under the wiring. An insulating layer is formed as necessary on the heat-generating resistance element and the wiring.

A protective layer for protecting the heat-generating resistance element is formed at least on a portion of the heat-generating resistance layer covering the heat-generating resistance element. The protective layer may be formed so as to extend to above a position at which the wiring is arranged. An electrically insulating property and/or an anti-cavitation property can be imparted to the protective layer. Such a protective layer can be formed of a material that can be used in a liquid ejection head such as Ta or Ir.

In Step (B), a surface of the substrate having the heat-generating resistance element arranged thereon is covered with a laminated structure in which the protective layer and the intermediate layer are laminated with an interface therebetween. When another layer such as an insulating layer is laminated on the heat-generating resistance element, the laminated structure of the protective layer and the intermediate layer is formed thereon.

In Step (C), through forming, at a predetermined position on the substrate, the resin layer forming the flow path forming member, the resin layer on the flow path forming member side and the protective layer on the substrate side are joined together via the intermediate layer. In the joined portion, the intermediate layer forms a joined surface with the resin layer on the flow path forming member side. Meanwhile, when Step (C) ends, a surface of the intermediate layer is exposed to the liquid contact portion on the substrate side in the flow path. In this state, Step (D) is performed to remove at least part of the intermediate layer to expose a portion of a surface of the protective layer thereunder, thereby forming a liquid contact portion formed of part of the protective layer.

Through combining the steps described above, a predetermined portion of the intermediate layer in the flow path can be removed with efficiency without performing a patterning step using a separately prepared resist pattern.

An organic intermediate layer can be formed on the intermediate layer at a portion of the intermediate layer other than the portion opposed to the heat-generating resistance element, in particular, at the joined portion of the substrate and the flow path forming member and at a portion other than the portion opposed to the heat-generating resistance element in the flow path.

Using the organic intermediate layer can further improve the adhesion between the substrate and the resin layer forming the flow path forming member. Further, the organic intermediate layer also has an effect of further improving insulation reliability. When it is supposed that, due to a more highly reactive type of ink or severer storage conditions, interface separation, electrical short circuit, or the like may occur, it is preferred to use the organic intermediate layer.

A method of manufacturing a liquid ejection head according to the present invention can include Steps (A) to (C). In other words, a liquid ejection head may be manufactured through performing Steps (A) to (C) and without performing Step (D). Further, Step (D) corresponds to an aging step described below, and may be performed subsequently to Steps (A) to (C), or may be performed independently of the manufacture of the liquid ejection head manufactured through performing Steps (A) to (C).

The shapes and the sizes of the heat-generating resistance element and the wiring, and thicknesses of the thermal storage and electrically insulating layer formed in the region under the heat-generating resistance element, the electrically insulating layer formed on the heat-generating resistance element, the intermediate layer, and the like are not specifically limited, and can be selected depending on a target function to be performed by the liquid ejection head.

The portion of the intermediate layer opposed to the heat-generating resistance element in the flow path can be removed through, under a state of filling the flow path with aqueous aging liquid, driving the heat-generating resistance element to impart thermal energy for ejection to the aqueous aging liquid in the flow path and ejecting the aqueous aging liquid through the ejection orifice. In this treatment using ejection of the aqueous aging liquid, in the bubbling chamber that is a region in the flow path in which thermal energy is imparted from the heat-generating resistance element, a portion of the intermediate layer in contact with a region in which heat generation causes bubbling is removed. Specifically, a region of the intermediate layer opposed to the heat-generating resistance element is removed. The region of the intermediate layer opposed to the heat-generating resistance element substantially spatially matches with a portion surrounded by a contour of an image obtained through projecting the shape of the heat-generating resistance element in plan view onto the intermediate layer. Alternatively, the region is slightly larger than that portion and includes the portion.

In general, a bottom portion of the bubbling chamber is formed as a surface including the heat-generating resistance element and larger than the heat-generating resistance element. In such a case, the intermediate layer may be left in a region other than the region opposed to the heat-generating resistance element in the bubbling chamber after the step of removing the intermediate layer.

After the intermediate layer is removed from the flow path, the intermediate layer left on the protective layer in the flow path can function as an insulating protective layer for the wiring connected to the heat-generating resistance element and for other structures, and is also effective as an insulating protective layer for covering a level difference caused when the wiring is formed with a wiring layer. In this way, the level difference formed in a direction from the wiring layer to the heat-generating resistance element can be covered with the remaining portion of the intermediate layer to improve a step coverage property, and thus, the wiring layer can have a large thickness to improve the energization efficiency. When the organic intermediate layer is laminated on the intermediate layer, the two-layer structure in which the organic intermediate layer is laminated on the intermediate layer is left in a region other than the region opposed to the heat-generating resistance element in the flow path.

Treatment using the aqueous aging liquid, that is, the aging step, can be performed when the fabrication of the liquid ejection head in which the liquid contact portion on the substrate side in the flow path is formed of the laminated structure of the protective layer and the intermediate layer ends, or in a desired step thereafter. Such a step after the fabrication ends is, for example, at the time of initial setup before or after the shipment of a liquid ejection device having the liquid ejection head mounted thereon. Therefore, the liquid ejection head in which the liquid contact portion on the substrate side in the flow path is formed of the laminated structure of the protective layer and the intermediate layer is also included in the present invention.

The aging treatment using the aqueous aging liquid is performed until the desired effect of removing the intermediate layer from the bubbling chamber is obtained, that is, until the region of the intermediate layer opposed to the heat-generating resistance element in the bubbling chamber is removed. It is conceivable that the intermediate layer is removed from the protective layer because a high temperature and high pressure environment is thought to be formed by bubbling caused in the aqueous aging liquid in the bubbling chamber by the thermal energy imparted from the heat-generating resistance element, and the portion of the intermediate layer exposed to the high temperature and high pressure environment collapses.

In order to attain the desired effect of removing the intermediate layer, a method in which the aqueous aging liquid is ejected through the ejection orifice a preset reference number of times can be preferably used. It is preferred that the reference number of times of ejection be selected so that the number of accumulated pulses of a drive signal applied to the heat-generating resistance element is $2\times10^7$ or less. In other words, it is preferred that the intermediate layer have a thickness with which desired adhesion between the substrate and the flow path forming member can be obtained and the intermediate layer can be removed from the protective layer when or before the ejection is performed the reference number of times for the aging treatment, for example, 80 nm to 150 nm.

Further, it is preferred that drive energy in the aging step of the heat-generating resistance element be substantially equal to or higher than drive energy in ejecting liquid such as ink for recording a character or an image or for surface treatment.

When the liquid ejected through the ejection orifice is aqueous ink, the aqueous ink itself or a dilute solution of the aqueous ink diluted with water or the like can be used as the aqueous aging liquid. When the diluted aqueous ink is used, the dilution factor may be set so that the desired aging effect can be obtained without affecting the performance of the liquid ejection head.

In relation to the manufacture of the liquid ejection head according to the present invention, Steps (A) and (B) are performed, and after that, the region of the intermediate layer opposed to the heat-generating resistance element may be removed not by the aging treatment described above but by patterning using a resist layer.

An exemplary embodiment of the present invention is described in detail below with reference to the attached drawings.

<Outline of Main Body of Device>

Figure 8:
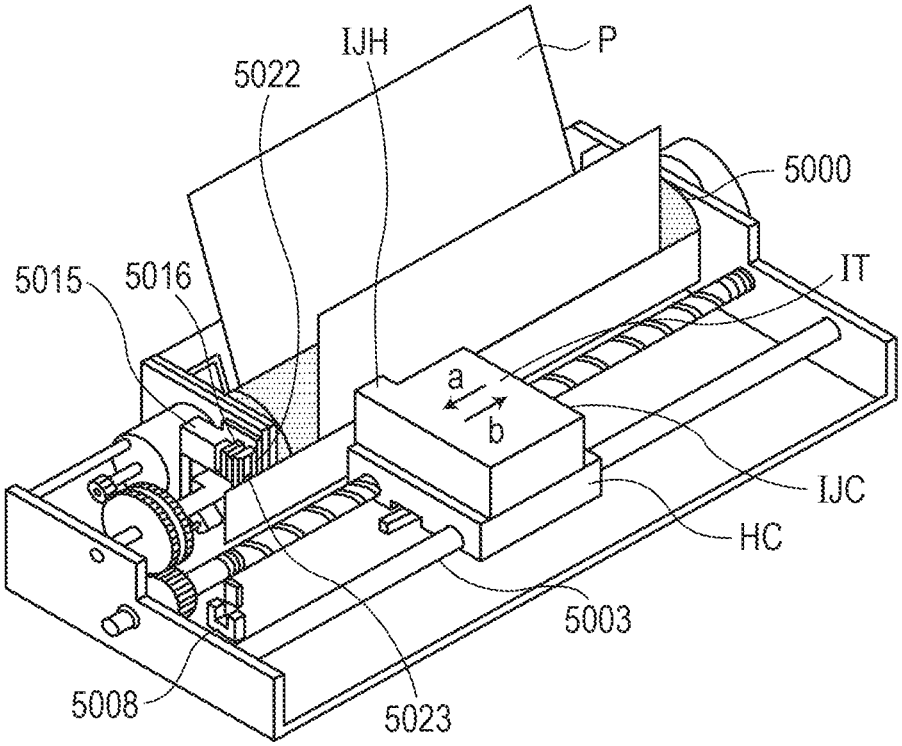
FIG. 8 is a schematic perspective view of a liquid ejection device to which the present invention is applied.

FIG. 8 is a perspective exterior view for schematically illustrating a structure of an ink jet printer according to a representative embodiment of the present invention.

In FIG. 8, an integrated ink jet cartridge IJC with a recording head IJH and an ink tank IT built therein is mounted on a carriage HC. The carriage HC is supported by a guide rail 5003 and reciprocates in directions of arrows a and b and performs printing on a recording medium P that is moved in a direction perpendicular to the moving direction of the carriage by a paper feed roller 5000. A support member 5016 is a member configured to support a cap member 5022 configured to cap a front surface of the recording head IJH. The inside of the cap member 5022 can be sucked by a sucker 5015. Through sucking the inside of the cap member 5022, the recording head returns to a normal state via an internal opening 5023 in the cap member 5022.

Next, the recording head IJH is described.

The recording head IJH includes a heat-generating resistance element as a unit configured to generate thermal energy as energy used for ejecting ink, and is a recording head in which a method of causing, with the thermal energy, change in state of the ink is adopted. Through using this method, a high density and a high resolution of a recorded character, image, or the like are attained. In particular, in this embodiment, an electrothermal conversion element is used as the heat-generating resistance element, and the ink is ejected using pressure due to a bubble that is generated when the ink is heated to cause film boiling thereof by the electrothermal conversion element. First, the entire structure of the recording head IJH is described.

Figure 7:
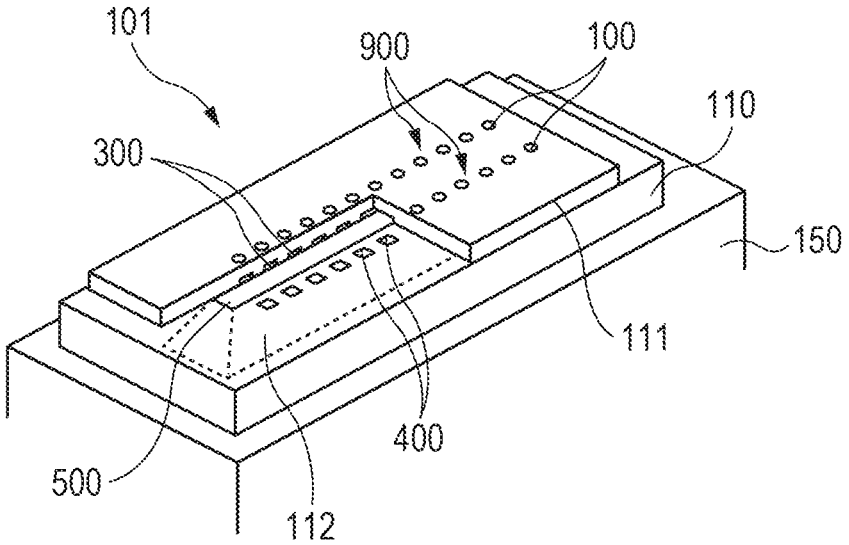
FIG. 7 is a schematic partially cutaway perspective view of a liquid ejection head according to an embodiment of the present invention to which the present invention is applicable.

FIG. 7 is a partially cutaway perspective view of the recording head IJH according to an exemplary embodiment of the present invention. A recording head 101 includes a recording element substrate that has a substrate 110 with a plurality of heat-generating resistance elements (heaters) 400, which are the electrothermal conversion elements, formed thereon and a flow path forming member 111 joined to a first surface of the substrate 110 to form a plurality of flow paths. The ink is ejected through ejection orifices in the recording head 101 in a direction perpendicular to the surface of the substrate 110 having the heaters 400 formed thereon.

The substrate 110 is formed of, for example, a material such as glass, ceramic, a resin, or a metal, or a composite material using two or more thereof. In general, a substrate formed of Si can be used. The heater 400, an electrode (not shown) configured to apply a voltage to the heater 400, and wiring (not shown) connected to the electrode are formed in a predetermined wiring pattern on the first surface of the substrate 110 for each flow path. Further, an insulating film (not shown) for improving a radiating property of stored heat is formed on the first surface of the substrate 110 so as to cover the heaters 400. Further, a protective film (not shown) for protecting the substrate surface from cavitation, which is caused when a bubble disappears, is formed on the first surface of the substrate 110 so as to cover the insulating film. A common liquid chamber 112 that pierces the substrate 110 from the first surface to a second surface opposed thereto and that communicates with an ink supply path 500 is formed in the substrate.

The flow path forming member 111 and the substrate 110 form a plurality of flow paths 300 and the ink supply path 500 configured to supply the ink to the flow paths 300. An ejection orifice 100 is formed in each of the flow paths 300 as an opening at a tip thereof. The plurality of ejection orifices 100 are formed correspondingly to the plurality of flow paths 300 at positions opposed to the plurality of heaters 400 formed on the substrate 110, respectively. In other words, a plurality of unit structures each including one flow path 300 and one ejection orifice 100 are formed independently of one another and correspondingly to the plurality of heaters 400, respectively.

The recording head 101 includes ejection orifice lines 900 arranged so that longitudinal directions thereof are in parallel with each other, i.e., a first ejection orifice line and a second ejection orifice line. The first ejection orifice line and the second ejection orifice line are opposed to each other across the ink supply path 500. An interval between adjacent two ejection orifices can be set so that 600 or 1,200 ejection orifices can be arranged in one inch.

EXAMPLES

In examples of the present invention described below, there are cases in which the second ejection orifice line as illustrated in FIG. 7 is omitted, a third ejection orifice line is included in addition to the first or second ejection orifice line, or a fourth ejection orifice line is further included (not shown).

Further, the ink supply path 500 may be divided into a plurality of supply paths (not shown) in the examples described below. Further, the ejection orifices can be arranged so that the ejection orifices in one ejection orifice line and the ejection orifices in another ejection orifice line of the two ejection orifice lines 900 in parallel with each other are staggered as necessary for a dot arrangement reason.

In the recording head having the structure as illustrated in FIG. 7, as in a recording head disclosed in Japanese Patent Application Laid-Open No. H04-010940 or Japanese Patent Application Laid-Open No. H04-010941, a bubble generated in the ink in the flow path when the ink is ejected communicates with outside air via the ejection orifice.

Various kinds of modes of the structure of the recording head according to the present invention are described below as examples.

Example 1

A recording head according to Example 1 of the present invention is described below.

Figure 2:
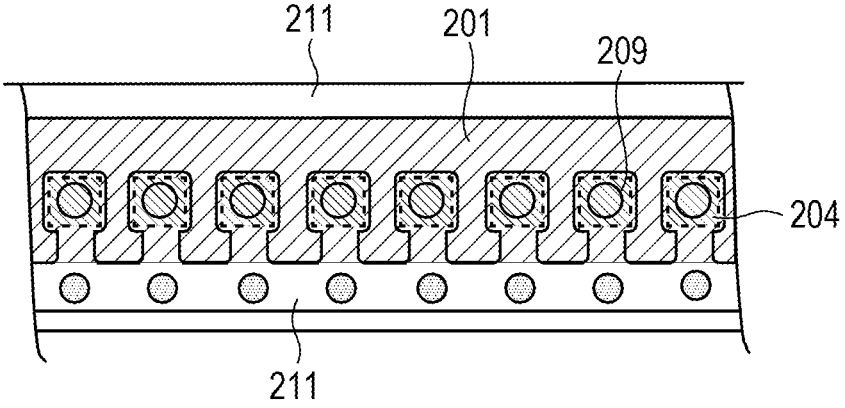
FIG. 2 is a schematic plan view for illustrating a structure of an ejection orifice line in the liquid ejection head before the aging treatment according to the first example of the present invention.

FIG. 2 is a schematic view for illustrating an ink ejecting portion of the recording head before the aging treatment, and is a plan view for illustrating an ejection orifice arrangement surface seen from above in the direction of the liquid ejection through the ejection orifices. A structure formed on the inner side of, i.e., the substrate side of the ejection orifice arrangement surface is also schematically illustrated in a transparent manner. In the recording head illustrated in FIG. 2, ejection orifices 209 are formed above heaters 204 so as to be opposed to the heaters 204, respectively. A protective layer 201 serving as an anti-cavitation protective film and the like are formed on the heaters 204. Further, an organic intermediate layer 211 is laminated on a portion of an intermediate layer 210 other than a region opposed to the heaters 204.

Figure 1B:
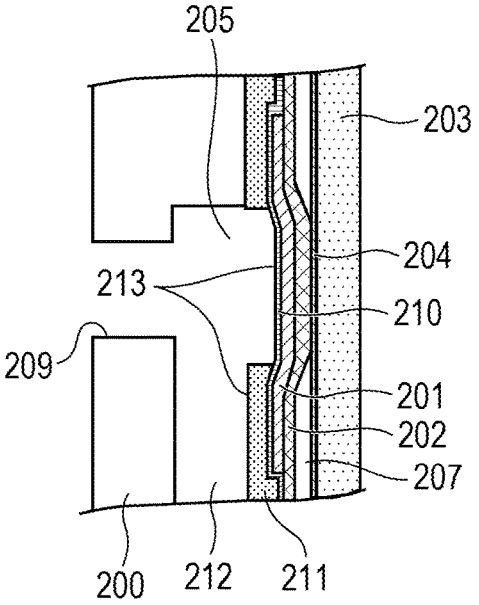
Figure 1C:
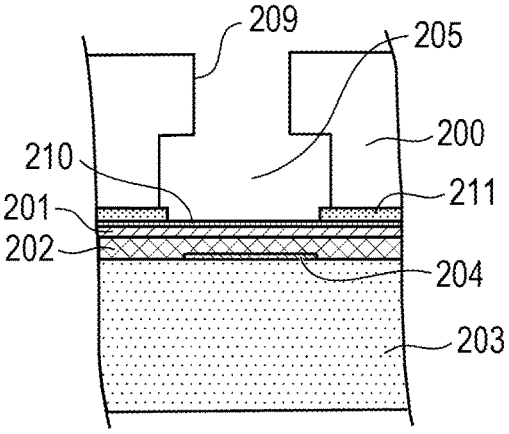

FIG. 1A to FIG. 1C are enlarged views for illustrating in detail a portion including the ejection orifice of the recording head illustrated in FIG. 2. FIG. 1A is a schematic partial enlarged plan view for illustrating the portion including the ejection orifice. Also in FIG. 1A, the structure formed on the inner side of, i.e., the substrate side of the ejection orifice arrangement surface is also schematically illustrated in a transparent manner. FIG. 1B is a schematic partial enlarged sectional view taken along the line 1B-1B of FIG. 1A, and FIG. 1C is a schematic partial enlarged sectional view taken along the line 1C-1C of FIG. 1A.

In FIG. 1A to FIG. 1C, a thermal storage layer 203 is formed on a surface of a Si substrate. The thermal storage layer 203 can be formed of a silicon oxide film formed by thermal oxidation of the surface of the Si substrate, by CVD, or the like, and a structure including a plurality of layers as a combination thereof may also be adopted.

The heater 204 is formed of a TaSiN film. Electrode wiring 207 for supplying power to the heater 204 is formed of an AlCu layer. An electrically insulating layer 202 is formed of a SiN film at a thickness of 300 nm. The protective layer 201 for resisting cavitation formed of a Ta film at a thickness of 230 nm is laminated on part of a region of the electrically insulating layer 202 covering the heater 204. The intermediate layer 210 containing a silicon carbonitride material is laminated on the protective layer 201 at a position covering at least the protective layer 201, i.e., in a range larger than that of the protective layer 201. The intermediate layer 210 has a thickness of 100 nm.

In this example, a $Si_xC_yN_z$ film according to the present invention is formed using plasma CVD. Through changing flow ratios of $SiH_4$, $NH_3$, and $CH_4$ serving as process gases, $Si_xC_yN_z$, films having different composition ratios can be obtained.

After the intermediate layer 210 is formed, the organic intermediate layer 211 formed of a polyetheramide resin is formed in a region other than the heat generating portion of the heater 204, i.e., in a portion other than the portion opposed to the heater 204. In the illustrated example, the organic intermediate layer 211 is formed on the joined portion of the substrate and the flow path forming member and on a portion other than the portion opposed to the heater 204 in the flow path.

A flow path forming member 200 having portions to be the side wall portions and the ceiling portion of a flow path 212 and the ejection orifice 209 is formed on the substrate as a layer formed by curing a photosensitive resin material. The photosensitive resin material is not specifically limited, and can be selected among materials used for a flow path forming member of a recording head. The portion formed of the resin layer of the flow path forming member may further have a portion formed of another material added thereto. For example, a surface in which the ejection orifice opens may undergo surface treatment such as formation of a water-repellent layer thereon.

As illustrated in FIG. 1A to FIG. 1C, the flow path forming member and the substrate are joined together via the joined portion formed at a portion other than the flow path. The joined portion is formed of a portion in which an insulating layer 202 on the substrate side, the protective layer 201, the intermediate layer 210, and the organic intermediate layer 211 are laminated, and the flow path forming member 200 formed of the resin layer. Those components can be joined together through forming, of a photosensitive resin material, a pattern of the flow path forming member on the substrate, curing the pattern through exposure, and further, curing the pattern with heat as necessary.

Through joining together the flow path forming member 200 and the protective layer 201 of the substrate, portions of the flow path forming member 200 to be the flow path become the side wall portions and the ceiling portion, and a surface on the substrate side of the protective layer 201 becomes a bottom portion 213 to form the flow path 212. The structure illustrated in FIG. 1A to FIG. 1C includes a portion on the protective layer 201 covered with the intermediate layer 210 and a portion in which the intermediate layer 210 and the organic intermediate layer 211 are laminated. In other words, a portion of a bottom portion of a bubbling chamber 205 corresponding to part of the flow path 212 that is opposed to the heat-generating resistance element does not have the organic intermediate layer 211 formed thereon.

A method of forming the illustrated layers and a method of forming the flow path forming member on the substrate are not specifically limited, and known methods can be used.

In the structure illustrated in FIG. 1A to FIG. 1C, through energizing and driving the heat-generating resistance element to impart thermal energy to the ink in the bubbling chamber for bubbling the ink, a liquid droplet can be ejected through the ejection orifice 209.

As described above, the problem in the related-art structure is that when ink composition is changed, the intermediate layer 210 and the protective layer 201 may be separated from each other depending on an ingredient contained in the ink. In Japanese Patent Application Laid-Open No. 2007-261170, the intermediate layer of SiN or SiO is formed. However, as described above, depending on an ingredient contained in the ink, the ingredient in the ink may dissolve the intermediate layer to cause separation between the flow path forming member and the substrate. In this example, through using, as the intermediate layer 210, a layer formed of a silicon carbonitride material, dissolution of the protective film can be suppressed. Further, it is preferred to use, as the intermediate layer 210, a layer formed of a silicon carbonitride material having the composition expressed by the composition formula (I) above. The reason is that dissolution of the protective film can be further suppressed with the use of a silicon carbonitride layer.

Through the steps described above, a recording head under a state in which the protective layer forming the bottom portion of the flow path is covered with the intermediate layer, that is, before the aging treatment, can be obtained.

In the examples described below, the intermediate layer on the heater is removed by performing the aging step with respect to the recording head, but the intermediate layer on the heater may be removed by patterning. Specifically, after the intermediate layer 210 is formed as illustrated in FIG. 1B and FIG. 1C, through patterning using a resist layer, the intermediate layer 210 formed on the heater 204 may be removed to expose the surface of the protective layer 201 above the heater as illustrated in FIG. 4G. In this case, after patterning the intermediate layer 210, the flow path forming member 200 is formed on the substrate.

Example 2

Next, a recording head according to Example 2 of the present invention is described.

Figure 3A:
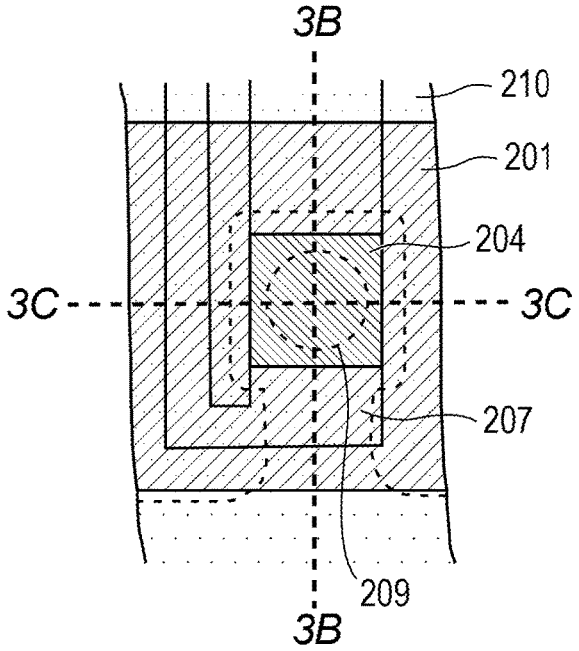
FIG. 3A, FIG. 3B, and FIG. 3C are a schematic plan view and schematic sectional views for illustrating a structure of a portion of a liquid ejection head having an ejection orifice arranged therein before aging treatment according to a second example of the present invention.
Figure 3B:
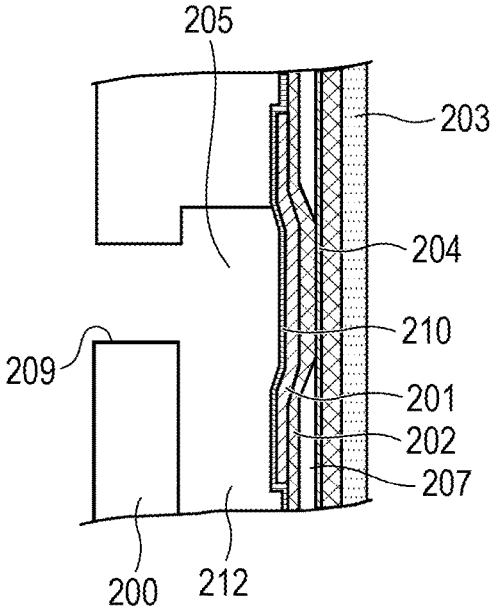
Figure 3C:
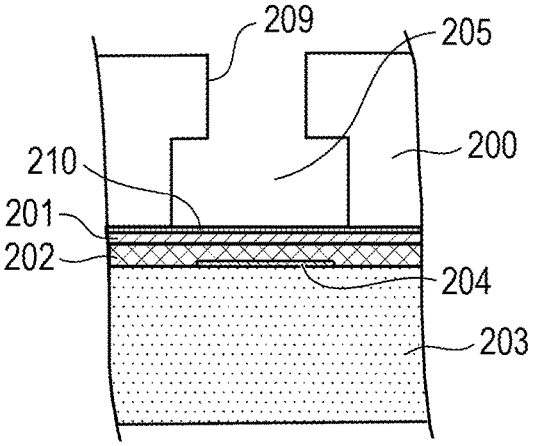

FIG. 3A to FIG. 3C are enlarged views for illustrating in detail a portion of the recording head including an ejection orifice. FIG. 3A is a schematic partial enlarged plan view of the portion including the ejection orifice. Also in FIG. 3A, the structure formed on the inner side of, i.e., the substrate side of the ejection orifice arrangement surface is also schematically illustrated in a transparent manner. FIG. 3B is a schematic partial enlarged sectional view taken along the line 3B-3B of FIG. 3A, and FIG. 3C is a schematic partial enlarged sectional view taken along the line 3C-3C of FIG. 3A.

A point different from Example 1 is that the organic intermediate layer 211 is eliminated. As described above, adhesion between the flow path forming member and the substrate is improved by a structure with the intermediate layer therebetween, and separation between the components can be prevented. It is known that, even when the organic intermediate layer 211 is not provided unlike the above case, resistance against ink of various kinds can be obtained and the structure has the effect of attaining improvement of the adhesion. Other structural elements except for the organic intermediate layer 211 are the same as those in Example 1, and thus, detailed description of like structural elements is omitted here.

Example 3

Through performing the aging step with respect to the recording head having the structure illustrated in FIG. 1A to FIG. 1C or FIG. 3A to FIG. 3C, the recording head according to Example 3 of the present invention can be obtained.

Next, the aging step is described with reference to FIG. 4A to FIG. 4C.

Figure 4A:
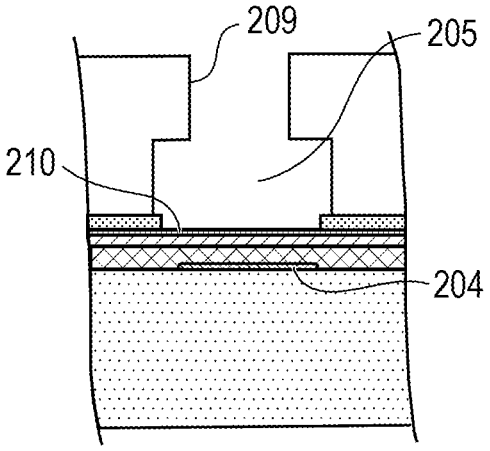
FIG. 4A, FIG. 4B, and FIG. 4C are schematic sectional views of the portion including the ejection orifice for illustrating an aging step according to the present invention.

FIG. 4A is a schematic partial sectional view of the recording head illustrated in FIG. 1B before the aging treatment.

First, the bubbling chamber 205 is filled with injected aqueous aging liquid 222. As the aging liquid, ink or a dilute solution thereof can be used.

Figure 4B:
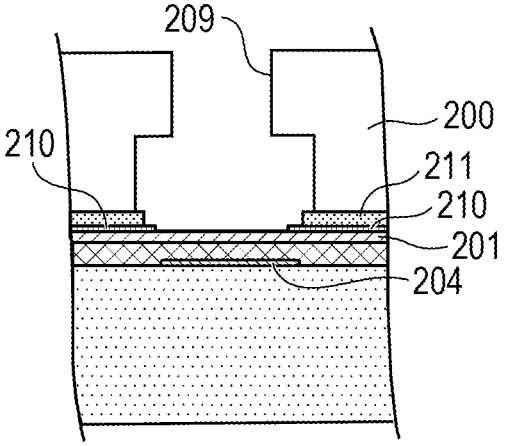
Figure 4C:
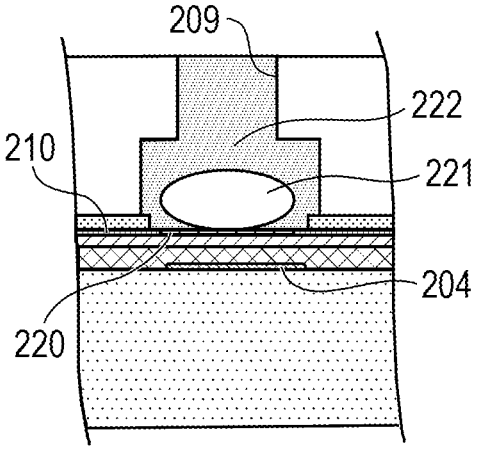

Then, as illustrated in FIG. 4B, through energizing and driving the heater 204, a bubble 221 is generated, and a portion of the intermediate layer 210 immediately below the region in which the bubble is generated is deteriorated to be separated. Through repeating the energization, similarly to regular ink ejection, the aging liquid 222 is ejected through the ejection orifice. Together with an ejected liquid droplet, a deteriorated portion of the intermediate layer 210 is discharged. As described above, as illustrated in FIG. 4C, a region 220 of the intermediate layer 210 immediately below a bubble generated through heating the aging liquid by the action of thermal energy from a portion of the protective layer 201 opposed to the heater 204 disappears in this heating and bubbling step. In other words, the portion of the intermediate layer 210 opposed to the heater 204 is removed by bubbling, and a surface of the protective layer 201 thereunder is exposed to be the liquid contact portion in contact with the liquid in the flow path.

Also in the recording head of Example 2 without the organic intermediate layer as illustrated in FIG. 3A to FIG. 3C, similar aging treatment for removing the intermediate layer can be performed.

A SiN film in which y=0 at. % and a SiCN film according to the present invention (x=47 at. %, y=16 at. %, and z=37 at. %) were formed on a substrate, and an immersion test (at 70° C. for three days) was performed with aqueous ink for ink jet including a pigment that contains an acrylic polymer and bisphosphonic acid. The result was that the SiN film was reduced by an amount of 281.5 nm, whereas the SiCN film was reduced by an amount of 10.1 nm. The silicon carbonitride material according to the present invention was more excellent in ink resistance than the SiN film. Further, a SiCN film according to the present invention (x=47 at. %, y=6 at. %, and z=47 at. %) was formed on a substrate, and an immersion test was performed similarly. The result was that the film was reduced by an amount of 70.6 nm. Through the tests, it was found that, from the viewpoint of ink resistance, y≥16 at. % was more preferred in the SiCN film.

Figure 5:
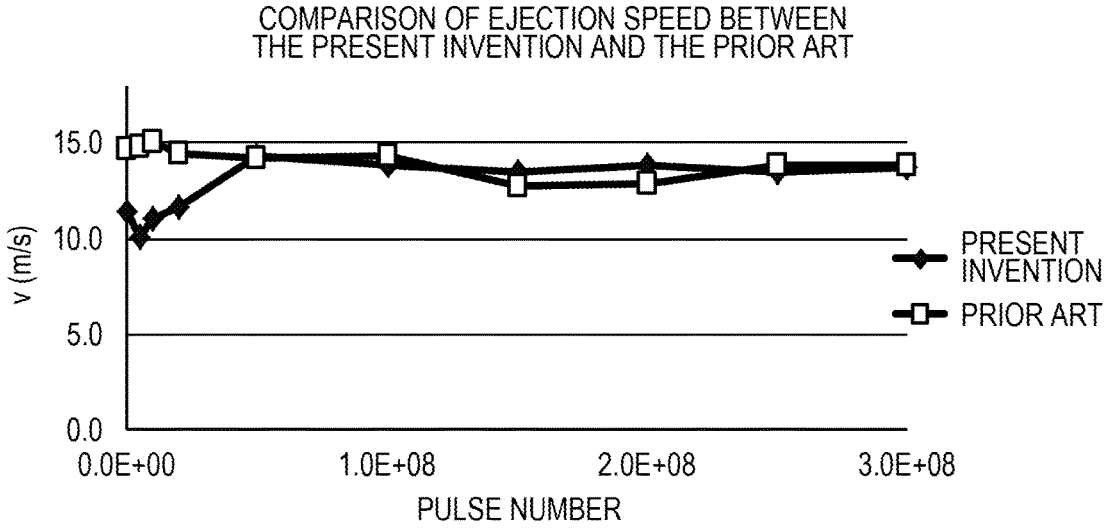
FIG. 5 is a graph of ejection speed for showing an effect of the aging step according to the present invention.

In FIG. 5, there is shown a relationship between the number of accumulated energization pulses and ejection speed (v) of the aging liquid when drive energization pulses are applied in the aging step. "PRESENT INVENTION" shows change in ejection speed in a liquid ejection head having a structure similar to that illustrated in FIG. 1A to FIG. 1C using the intermediate layer 210, and "RELATED ART" shows change in ejection speed in a liquid ejection head having a structure similar to that of "PRESENT INVENTION" except that the intermediate layer 210 is not used. A drive energization pulse time in the aging step is set to impart energy that is approximately 1.3 times as high as critical bubbling energy at which bubbling starts and is higher than that of regular print drive. The aging step in the related-art liquid ejection head is often performed with higher energy than that under regular print drive conditions because the aging step is performed depending on the ink and the liquid ejection head used.

Figure 6:
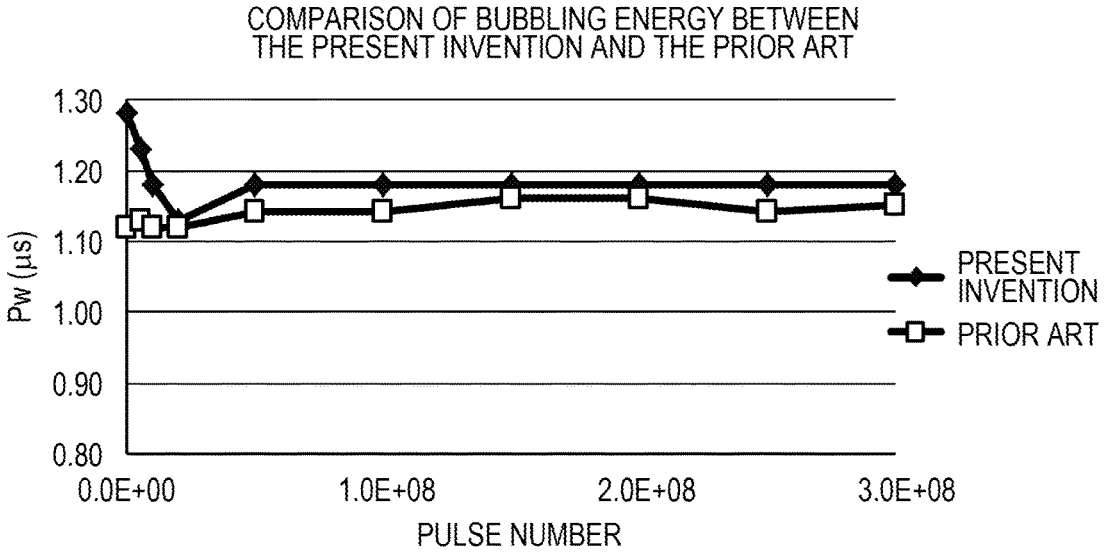
FIG. 6 is a graph of critical bubbling energization time for showing an effect of the aging step according to the present invention.

In FIG. 6, there is shown a relationship between the number of accumulated energization pulses and critical bubbling energy (Pw: energization pulse time) at which bubbling of the aging liquid starts when drive energization pulses are applied in the aging step. "PRESENT INVENTION" and "RELATED ART" in FIG. 6 are as described with reference to FIG. 5. In the related-art liquid ejection head, when the critical bubbling energy is not stable, such an aging step is also performed. In the related-art liquid ejection head, due to ink burn, the critical bubbling energy is often significantly changed by aging.

As is apparent from FIG. 5, in the liquid ejection head according to the present invention, the initial ejection speed is lower than that of the related-art liquid ejection head, and the intermediate layer 210 lowers the ejection efficiency. However, through application of approximately $2\times10^7$ pulses, the intermediate layer is removed and sufficiently reliable ejection speed is recovered.

Also in FIG. 6, in the liquid ejection head according to the present invention, the initial bubbling energy is higher than that of the related-art liquid ejection head by about 20%, and the intermediate layer 210 lowers the bubbling efficiency. However, through application of approximately $2\times10^7$ pulses, also in this case, the energy becomes substantially the same as that of the related-art liquid ejection head. As described above, through adding the aging step, the bubbling efficiency can be prevented from being lowered due to the additionally formed intermediate layer 210.

The drive energization pulses in the aging step impart energy that is approximately 1.3 times as high as bubbling energy when ink is ejected in recording operation, which is acceptable. However, energization with still higher energy can reduce time necessary for the aging treatment.

Further, through adding the aging step, a step of patterning the intermediate layer can be omitted, which has an effect of reducing costs. Further, only a portion of the intermediate layer directly above the heater can be removed, and thus, the intermediate layer also acts as an insulating protective film. Therefore, there is also an effect of being able to improve the step coverage property at the level difference with the wiring layer at an end of the heater, thereby allowing a thicker wiring layer.

Further, the aging step may be performed as part of a sequence of setting up a recording apparatus. Specifically, through automatically performing the same operation as that in the aging step at the time of initial setup when a customer uses the recording apparatus at the first time, the same effect as that of the aging step can be obtained.

The intermediate layer contains the silicon carbonitride material having the composition expressed by the composition formula (I) above, and thus, the portion of the intermediate layer opposed to the heat-generating resistance element can be removed from the flow path more efficiently. Therefore, also from the viewpoint of aging treatment, it is preferred that the intermediate layer contain a silicon carbonitride material having the composition expressed by the composition formula (I).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-168053, filed Aug. 27, 2015, which is hereby incorporated by reference herein in its entirety.

What is claimed is:

1. A liquid ejection head, comprising:

a flow path forming member including a resin layer having a flow path;

a substrate including a heat-generating resistance element for ejecting liquid and a protective layer having a portion for covering the heat-generating resistance element, a surface of the portion being exposed to the flow path; and an intermediate layer formed between the resin layer and the protective layer in a direction perpendicular to a surface of the substrate having the heat-generating resistance element provided thereon, the intermediate layer comprising a silicon carbonitride material.

2. A liquid ejection head according to claim 1, wherein the intermediate layer comprises a material expressed by $Si_xC_yN_z$, where x+y+z=100 (at. %), 30≤x≤59 (at. %), y≥5 (at. %), and z≥15 (at. %).

3. A liquid ejection head according to claim 2, where y≥16 (at. %).

4. A liquid ejection head according to claim 1, wherein the protective layer comprises at least one of a Ta film and an Ir film.

5. A liquid ejection head according to claim 1, further comprising an organic intermediate layer between the resin layer and the intermediate layer in the perpendicular direction.

6. A liquid ejection head according to claim 5, wherein the intermediate layer contacts the organic intermediate layer.

7. A liquid ejection head according to claim 5, wherein the intermediate layer has a portion protruding from the organic intermediate layer to the flow path side.

8. A liquid ejection head according to claim 1, wherein the intermediate layer is not formed over the surface of the portion of the protective layer.

9. A liquid ejection device having the liquid ejection head of claim 1 mounted thereon.

10. A liquid ejection head according to claim 1, wherein the intermediate layer contacts the protective layer.

11. A liquid ejection head according to claim 1, wherein the intermediate layer has a portion protruding from the resin layer to the flow path side.

12. A liquid ejection head according to claim 1, wherein the substrate has a surface on which a first heat-generating resistance element and a second heat-generating resistance element are formed, the resin layer has a portion formed between the first heat-generating resistance element and the second heat-generating resistance element when viewed from a direction perpendicular to the surface of the substrate, and the intermediate layer is formed between the portion of the resin layer and the protective layer.

13. A liquid ejection head according to claim 1, further comprising an electrically insulating layer covering the heat-generating resistance element and formed between the heat-generating resistance element and the protective layer in the perpendicular direction.

14. A liquid ejection head according to claim 1, wherein the resin layer, the protective layer and the intermediate layer at least overlap each other in the perpendicular direction.

15. An aging treatment method for a liquid ejection head, the liquid ejection head including:

a flow path forming member including a resin layer having a flow path formed therein;

a substrate including a heat-generating resistance element for ejecting liquid and a protective layer for covering the heat-generating resistance element; and an intermediate layer formed between the resin layer and the protective layer in a direction perpendicular to a surface of the substrate having the heat-generating resistance element provided thereon, the intermediate layer comprising a silicon carbonitride material, the aging treatment method comprising an aging step of removing the intermediate layer laminated on a portion of the protective layer opposed to the heat-generating resistance element to expose a surface of the portion of the protective layer.

16. An aging treatment method for a liquid ejection head according to claim 15, wherein the intermediate layer comprises a material expressed by $Si_xC_yN_z$, where x+y+z=100 (at. %), 30≤x≤59 (at. %), y≥5 (at. %), and z≥15 (at. %).

17. An aging treatment method for a liquid ejection head according to claim 15, wherein the step of removing the intermediate layer is performed in an aging step of filling the flow path with aqueous aging liquid and driving the heat-generating resistance element to eject the aqueous aging liquid through the ejection orifice.

18. An aging treatment method for a liquid ejection head according to claim 17, wherein ejection of the aqueous aging liquid through the ejection orifice in the aging step is performed until a number of times of the ejection reaches a preset reference number of times.

19. An aging treatment method for a liquid ejection head according to claim 18, wherein the reference number of times is selected so that an accumulated number of pulses of a drive signal applied to the heat-generating resistance element is $2\times10^7$ or less.

20. An aging treatment method for a liquid ejection head according to claim 17, wherein drive energy in the aging step of the heat-generating resistance element is substantially equal to or higher than drive energy in ejecting the liquid.

21. An aging treatment method for a liquid ejection head according to claim 17, wherein the liquid ejected through the ejection orifice comprises aqueous ink, and the aqueous aging liquid comprises one of the aqueous ink and a dilute solution of the aqueous ink.

22. An aging treatment method for a liquid ejection head according to claim 15, wherein the aging step is performed after fabrication of the liquid ejection head is completed.

23. An aging treatment method for a liquid ejection head according to claim 15, wherein the aging step is performed at initial setup after the liquid ejection head is shipped.

24. An initial setup method for a liquid ejection device after shipment thereof, comprising the aging treatment method of claim 15.

* * * * *